US008569915B1

(12) United States Patent
Schweitzer, III et al.

(10) Patent No.: US 8,569,915 B1
(45) Date of Patent: Oct. 29, 2013

(54) HIGH SPEED CONTACT CAPABLE OF DETECTING, INDICATING AND PREVENTING MALOPERATION DUE TO INTERNAL FAILURE

(71) Applicant: Schweitzer Engineering Laboratories, Inc., Pullman, WA (US)

(72) Inventors: Edmund O. Schweitzer, III, Pullman, WA (US); Tony J. Lee, Pullman, WA (US)

(73) Assignee: Schweitzer Engineering Laboratories Inc, Pullman, WA (US)

( * ) Notice: Subject to any disclaimer, the term of this patent is extended or adjusted under 35 U.S.C. 154(b) by 0 days.

(21) Appl. No.: 13/622,873

(22) Filed: Sep. 19, 2012

(51) Int. Cl.
*H01H 3/00* (2006.01)

(52) U.S. Cl.
USPC ..... 307/139

(58) Field of Classification Search
USPC ..... 307/139
See application file for complete search history.

(56) References Cited

U.S. PATENT DOCUMENTS 5,652,688 A 7/1997 Lee
6,956,725 B2 10/2005 Boughton

OTHER PUBLICATIONS

Tony Lee, Joe Mooney, Two Hybrid Contact Output Circuits, Sep. 25, 1998.
Tony Lee, Edmund O. Schweitzer III, Measuring and Improving the Switching Capacity of Metallic Contacts, 26th Annual Western Protective Relay Conference, Oct. 26-28, 1999.

*Primary Examiner* — Robert L. Deberadinis
(74) *Attorney, Agent, or Firm* — Eugene M. Cummings, PC

(57) ABSTRACT

A hybrid contact comprising a metallic contact in parallel with a pair of power transistors detects a failure in the ON state, corrects the failure if possible, and notifies a user via an alarm of the failure.

9 Claims, 5 Drawing Sheets

Close Sequence

HIGH SPEED CONTACT CAPABLE OF DETECTING, INDICATING AND PREVENTING MALOPERATION DUE TO INTERNAL FAILURE

PERTINENT FIELD

The present disclosure relates to high speed power switching contacts, and in particular to high speed power switching contacts constructed from a metallic contact in parallel with one or more power transistors, and more particularly still to systems and methods of detecting a failure of one of the power transistors, indicating a detected failure, and preventing improper operation due to a detected failure.

BRIEF DESCRIPTION OF THE DRAWINGS

Although the characteristic features of this disclosure will be particularly pointed out in the claims, the disclosure itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE ILLUSTRATED EMBODIMENT

Metallic contacts are the standard for switching large amounts of electrical power, and for good reason; metallic contacts have nearly ideal properties when they are either open or closed. When open, a properly designed metallic contact can easily withstand thousands of volts without breaking down. While closed, the resistance of a metallic contact is often less than a milliohm. However, metallic contacts generally perform poorly during the transition between the open state and the close state, and vice versa, when compared to power transistors. When a metallic contact breaks a current flow, some amount of arcing is usual, and in some cases, when the voltage across the terminals and the amount of current to interrupt are sufficient, the contact can actually weld shut. Similarly, when metallic contacts are closed; i.e., a connection is made, the process of closing the contacts can take a comparatively long time when compared to power transistors.

In the case of interrupting current flow, power transistors can switch from the off state to the on state very quickly; in some cases on the order of nanoseconds, and almost universally, within 100 or so microseconds. Accordingly, when deployed in an AC system, the power transistors can be turned off at a point of zero current with fair precision, eliminating the possibility of an arc. In addition, a connection can be made almost instantly as needed. Accordingly, power transistors exhibit far better behavior when switching from the off state to the on state and vice versa.

However, power transistors do not have the nearly ideal characteristics of metallic contacts when in the open or closed states. In particular, power transistors dissipate significant power when on due to a substantial voltage drop over a power transistor's conducting pathway, and can tolerate a limited reverse voltage when off. In addition, power transistors always conduct some amount of current, even when in the off state, and tend to have a limited lifespan when compared to metallic contacts.

Figure 1:
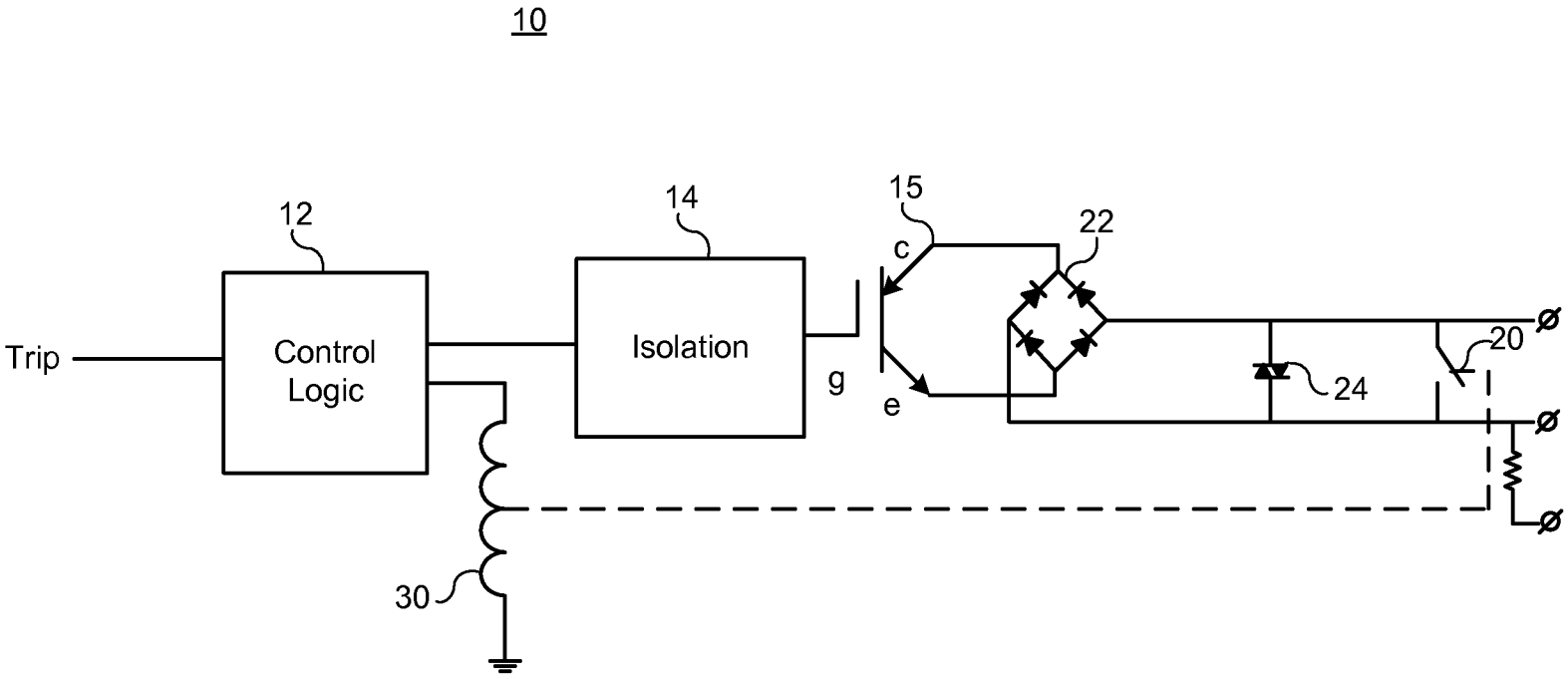
Figure 1 (Prior Art)
FIG. 1 is a simplified schematic diagram of a prior art hybrid contact utilizing a metallic contact in parallel with a power transistor.

For example, FIG. 1 depicts a prior art hybrid contact 10. A power transistor 15 is disposed in parallel to a metallic contact 20, with respect to a load (not shown). When the hybrid contact 10 is closed, the controller 12 simultaneously activates the power transistor 16 and the metallic contact 20. The power transistor 16 begins to conduct after just a few microseconds, and carries all of the load current until the metallic contact 20 closes. The effective resistance of the metallic contact 20 is far lower than the effective resistance of the power transistor 16, so substantially all current flows through the metallic contact 20, once the metallic contact closes.

To provide the capability of interrupting high current flows, the control logic 12 first opens the metallic contact 20, which typically takes several milliseconds to respond. As the metallic contact 20 opens current begins to flow through the power transistor 16 until the power transistor 16 carries all current flow. MOV 24 is disposed to dissipate any inductive kick from the load as the metallic contact 20 opens. Bridge rectifier 22 allows the hybrid contact to be used with AC loads and sources.

As explained in more detail below, the controller 12 is electrically isolated from the metallic contact 20 by control coil 30. In addition, the controller is electrically isolated from the first transistor 16 by isolation device 14.

However, these combinations suffer from certain shortcomings. In particular, the hybrid devices have no way of detecting the failure of the relatively fragile power transistor, which can fail in the on state, and thereby provide power to a load that is not supposed to be powered.

Accordingly, there exists a need for an improved hybrid contact that can detect the failure of a power transistor, warn users of such a failure, and take action to prevent the improper operation of the hybrid contact when such a failure is detected.

Figure 2:
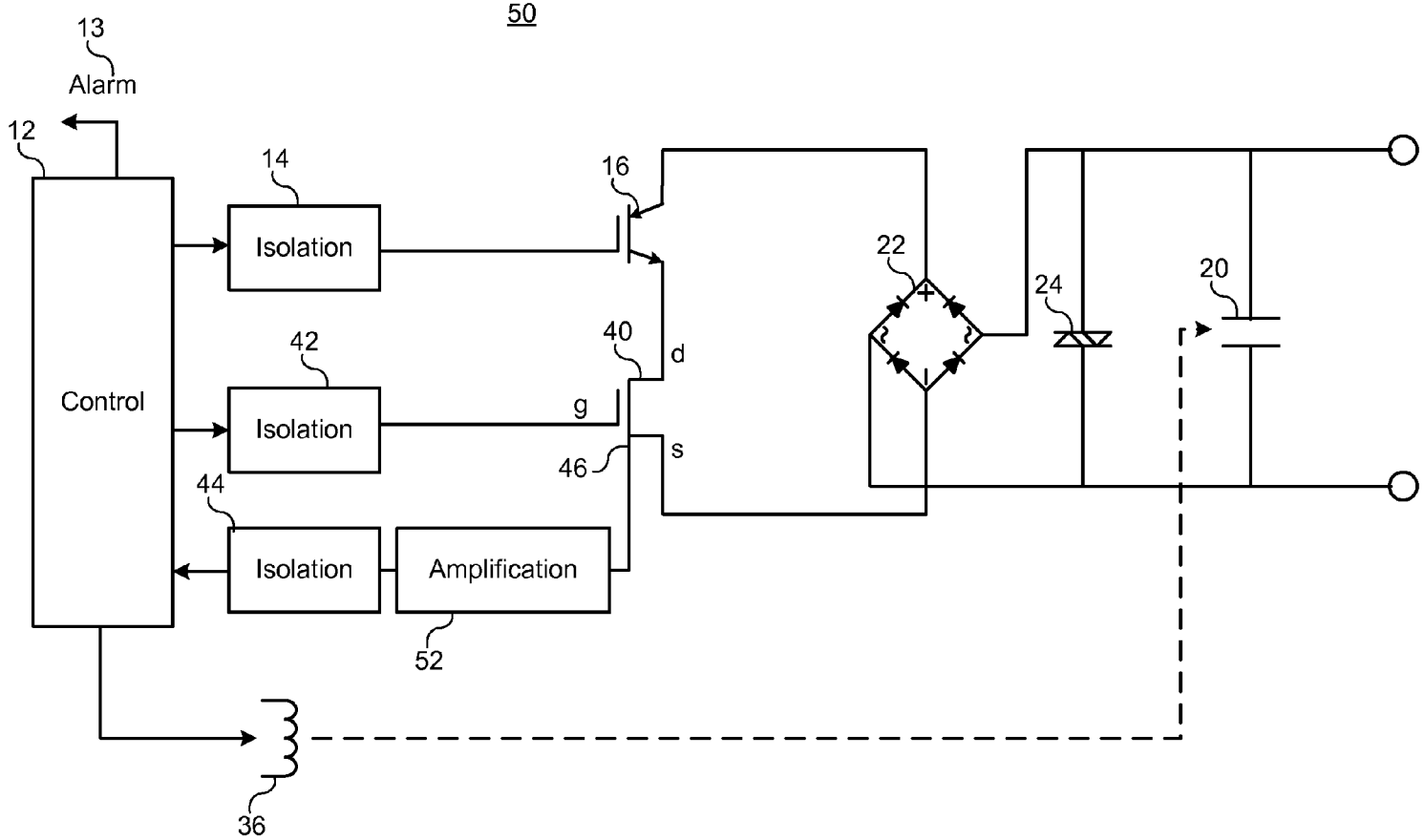
FIG. 2 is a simplified schematic diagram of the disclosed hybrid contact.

Turning to FIG. 2, an improved hybrid contact 50 is depicted. The hybrid contact 50 comprises a first power transistor 16 disposed in series with a second power transistor 40. The series combination of the power transistors 16 and 40 are electrically disposed in parallel with a metallic contact 20. A controller 12 operates the power transistors 16 and 40 and the metallic contact 20 to advantageously make and break power flow to a load (not shown). The controller 12 is coupled to the metallic contact 20 through a first control coil 36. The controller is also coupled to the first power transistor 16, which may be, for example, an insulated gate bipolar transistor, through a second isolation circuit 14, and to the second power transistor 40, which may be a sense FET, through a third isolation circuit 42. As with the hybrid contact of FIG. 1, the hybrid contact of FIG. 2 also includes a rectifier 22 to interface with AC sources and loads, and a MOV 24 to absorb any inductive kick from the load (not shown) that could damage the power transistors. Controller 12 also operates alarm output 13 as described herein.

The second power transistor 40 provides a sense point 46. One example of a power transistor that provides a sense point 46 is a sense FET (sFET), which is a field effect transistor with a sense terminal that maintains a current flow proportional to the current flow from drain to source. The sense point provides a voltage that is proportional to the current flow across the power transistor 40; i.e., in the case of a sense FET (sFET), the sense point 46 provides a signal indicative of the current flow from drain to source of the sFET. For example, if 10 amps flow from drain to source, the sense terminal may source 10 mA of current. This signal is amplified by an amplification circuit 52 and then coupled to the controller 12 through a fourth isolation circuit 44.

Isolation circuits are used between the control logic and the power stage to prevent large magnitude spikes, which may occur at the power switching portion of the hybrid contact 50, from damaging sensitive components on the control side. There are various ways to achieve isolation. Two well-known methods are isolation transformers and optocouplers. Isolation transformers provide isolation as the primary and secondary windings have no physical connection; all energy transfer operates through induction. Optocouplers also provide a way to transfer signals from the power stage to the control logic without risking damage to sensitive control components. Optocouplers operate through the use of a light emitting diode on one side and a phototransistor on the other side. Both isolation transformers and optocouplers can provide for passing control signals as well as analog signals. While isolation transformers and optocouplers are the best known methods of providing electrical isolation, this disclosure should in no way be limited to these methods of providing electrical isolation. For example, the use of capacitive coupling between the control logic and the power stage would be encompassed by this disclosure.

The addition of the second power transistor 40 and its sense point 46 allows the improved hybrid contact 50 to detect when the IGBT first power transistor 16 has failed. In particular, the controller 12 can use the sense point 46 to determine if current is flowing through the second transistor 40 when it should not be. For example, if the first power transistor 16 fails in the on position, and it should be in the off position, the sense point 46 will indicate a positive voltage drop across the second power transistor 40. In the opposite situation, the sense point 46 will indicate a nominal voltage drop across the second power transistor 40.

Figure 3A:
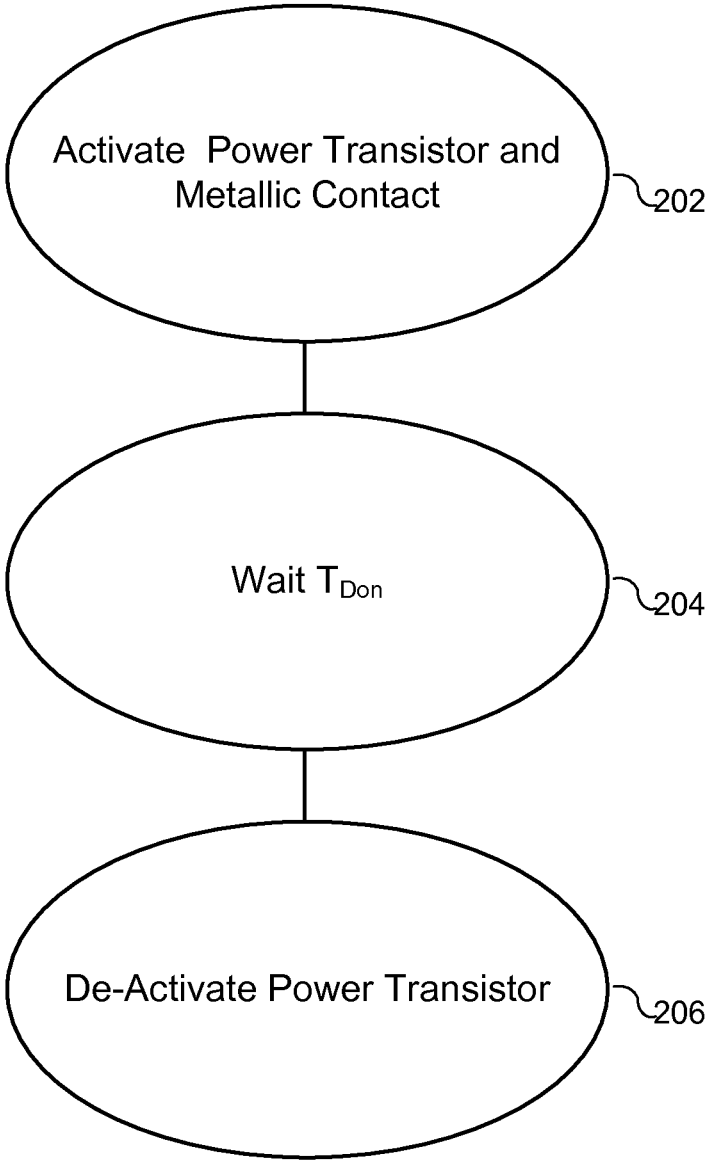
FIGS. 3A and 3B are flow charts illustrating the make and break operation of the hybrid contact respectively.

Turning to FIG. 3A, a simplified sequence of steps executed by the controller to make a connection with the hybrid contact is illustrated. In steady state operation, the second power transistor 40 is turned on for reasons discussed below with the explanation of the break operation of the hybrid contact. Accordingly, this sequence will not activate the second power transistor. In step 202 the first power transistor 16 and the metallic contact 20 are activated. The controller then waits for a period $T_{Don}$, which may be, for example, 8 milliseconds, in step 204. Finally, in step 206, the first power transistor 16 is deactivated. In one embodiment, the first power transistor is activated prior to the metallic contact so that a normal load current can be measured through the sense point and stored by the controller to reference when breaking a connection. In another embodiment, the first power transistor is activated simultaneously with activation of the metallic contact.

Figure 3B:
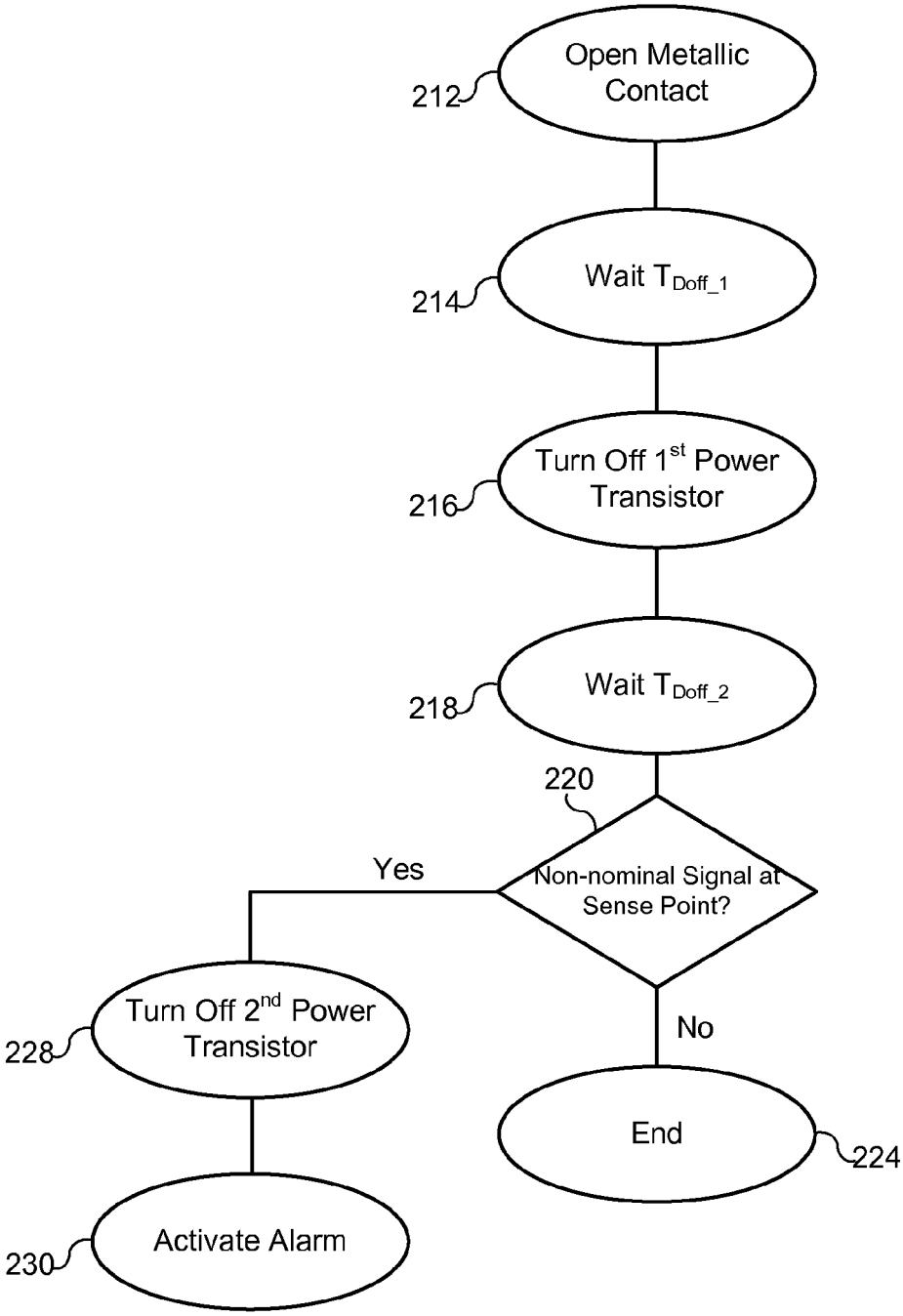

FIG. 3B illustrates a simplified sequence of steps executed by the controller to break a connection with the hybrid contact. In step 212 the metallic contact 20 is opened. The controller then waits a period $T_{Doff1}$, which may be, for example, 8 milliseconds, to allow the metallic contact 20 to physically open. During this period, current flow will transition from the metallic contact 20 to the first power transistor 16 and the second power transistor 40, thereby preventing an arc from occurring while the metallic contact 20 opens. After waiting for the metallic contact 20 to open the controller will turn off the first power transistor 16. Note that the second power transistor 40 is left on. The controller then waits for a period $T_{Doff2}$, which may be, for example, 1 millisecond, and then polls the sense point 46 in step 220 to determine if current is still flowing through the first power transistor 16 and the second power transistor 40. If current is still flowing across the second power transistor 40, the first power transistor 16 must have failed in the ON position, and execution transitions to step 228, where the second power transistor 40 is turned off, and to step 230 where an alarm output 13 is activated. If the sense point 46 indicates that current is no longer flowing through the second power transistor 40 then the hybrid contact 50 functioned properly and execution transitions to step 224, end.

In one embodiment, the hybrid contact may be employed in a system wherein the metallic contact 20 is normally open and first power transistor 16 is off. For example, an intelligent electronic device (IED) used in the monitoring, control, protection, and/or automation of electric power delivery systems, the contact outputs may be in a normally open state, and the first power transistor 16 may be off. In such an embodiment, the system could periodically check the status of the first power transistor 16. That is, the system may briefly turn on second power transistor 40 (for example, for 1 millisecond or less), and poll the sense point 46 to determine if current is flowing through the first power transistor 16. If current is detected to be flowing through first power transistor 16, the first power transistor 16 must have failed in the ON position, and the system may activate an alarm output such as output 13, and may also suspend further checks. If no current is detected to be flowing through first power transistor 16, then no failure is detected. Such checks may be performed periodically, on a scheduled basis, after a certain time period after the contact is opened, upon command from a user or supervisory system, or the like.

Figure 4:
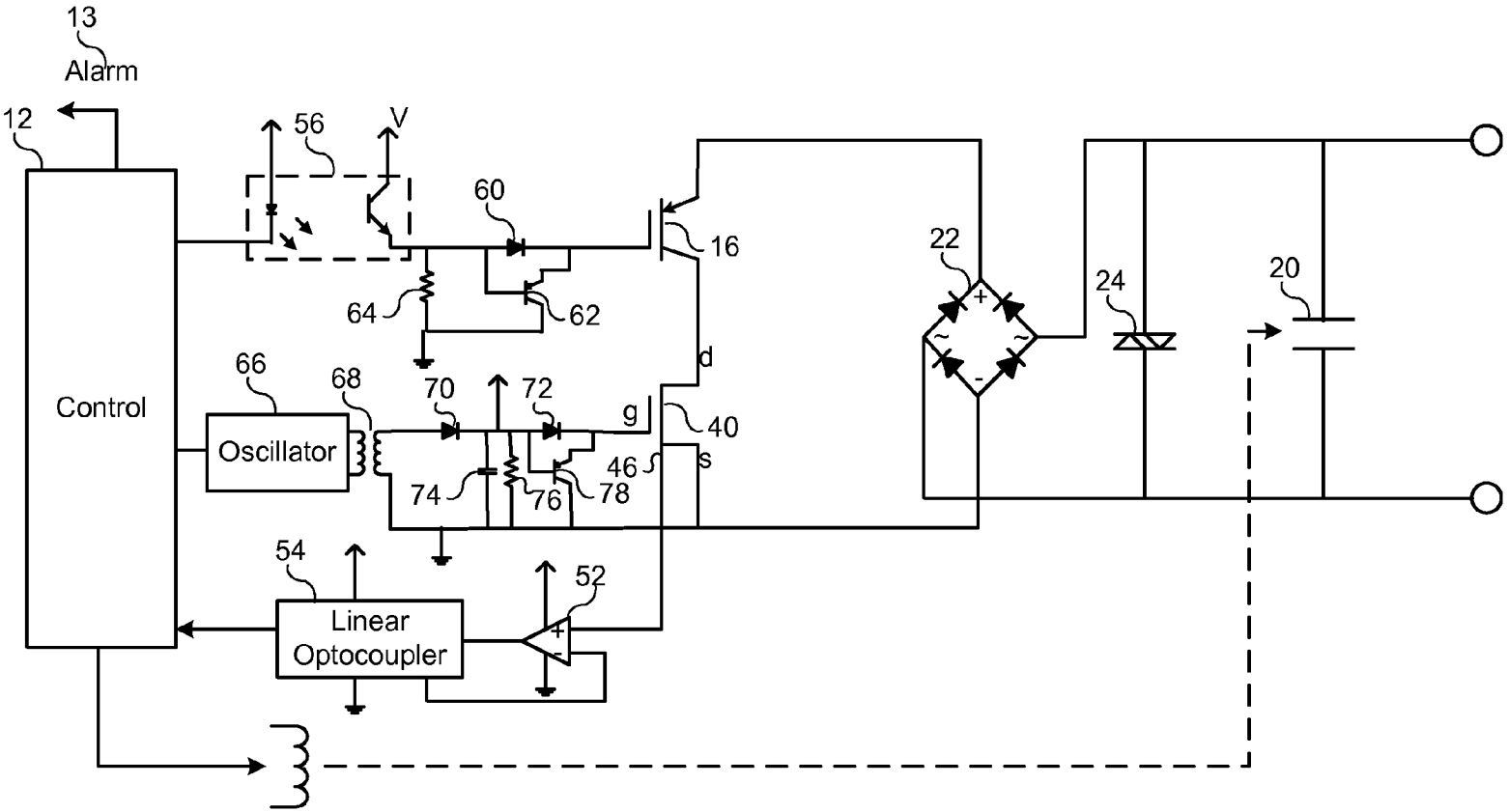
FIG. 4 is a schematic diagram of one aspect of the disclosed hybrid contact.

FIG. 4 depicts a more detailed schematic diagram of the disclosed hybrid contact. A controller is connected to an optocoupler 56, which effectively provides an isolated digital control signal between the controller 12 and the first power transistor 16. In particular, an output line from the controller pulls the cathode of the optocoupler's photodiode low, which optically activates the phototransistor on the power stage side. The output of the phototransistor is pulled low by resistor 64, which also serves to limit the current flow through the phototransistor when activated. When activated, the output of the phototransistor is pulled up to voltage level V, which activates the first power transistor 16.

When turning the first power transistor 16 off, the controller 12 returns the cathode of the optocoupler's photodiode to high, which optically deactivates the phototransistor on the power stage side. Diode 60 forces charge from first transistor 16 to flow through transistor 62, which pulls the gate of first power transistor 16 low, this turning it off.

The operation of the second power transistor 40 is controlled by the controller 12 using oscillator 66 and transformer 68. As described herein, when oscillator 66 is activated, it generates an AC waveform at a fixed frequency, which powers the drive circuitry on the secondary of transformer 68. In one embodiment the frequency is around 500 kHz. In other embodiments, the frequency may be higher or lower, which selection may depend on the specification of transformer 68. In particular, oscillator 66 is activated by an output line of controller 12. The oscillator generates an AC signal, which is inductively coupled across transformer 68. The AC signal generated at the output of transformer 68 feeds a DC power circuit comprised of rectifier diode 70, filter capacitor 74 and resistor 76. When the DC power level reaches a threshold level, the second power transistor 40 will switch on.

When turning the second power transistor 40 off, the controller 12 deactivates oscillator 66, which ceases to generate the AC waveform. Accordingly, the signal is no longer inductively coupled across transformer 68, and the DC power circuit is no longer fed thereby. Diode 72 forces charge from the second power transistor 40 to flow through transistor 78, which pulls the gate of the second power transistor 40 low, turning it off.

The sense output 46 of the second power transistor 40 is passed back to the controller 12 through an amplifier 52 and a linear optocoupler 54, such as, for example, a Vishay IL300. The optocoupler 54 has two substantially equal outputs. One output is connected back to the inverting input of amplifier 52, while the other output is connected to the control block. It should be noted that amplifier 52 may be one of many different means of providing amplification, such as, for example, operational amplifiers, transistor amplifiers, and instrument amplifiers, among other well known options.

The foregoing description of the disclosed hybrid contact has been presented for purposes of illustration and description, and is not intended to be exhaustive or to limit the disclosure to the precise form disclosed. The description was selected to best explain the principles of the disclosed hybrid contact and practical application of these principles to enable others skilled in the art to best use the disclosed hybrid contact in various embodiments and various modifications as are suited to the particular use contemplated. It is intended that the scope of the disclosed hybrid contact not be limited by the specification, but be defined by the claims set forth below.

What is claimed is:

1. A high speed contact for making or breaking a connection in a power system, the high speed contact comprising:

a metallic contact switching device having a first terminal and a second terminal, the switching device configured to make or break an electrical connection between the first terminal and the second terminal in response to a first control signal;

first power transistor having a third terminal and a fourth terminal, the power transistor configured to transition between an on state and an off state in response to a second control signal, the on state allowing electrical conduction from the third terminal to the fourth terminal, and the off state blocking electrical conduction from the third terminal to the fourth terminal;

the third terminal electrically coupled to the first terminal;

a second power transistor having a fifth terminal and a sixth terminal, the second power transistor configured to transition between an on state and an off state in response to a third control signal, the on state allowing electrical conduction from the fifth terminal to the sixth terminal, and the off state blocking electrical conduction from the fifth terminal to the sixth terminal;

the second power transistor adapted to provide a sense signal proportional to a current flow between the fifth terminal and the sixth terminal, the fifth terminal electrically coupled to the fourth terminal and the sixth terminal electrically coupled to the second terminal; and a controller.

2. The high speed contact of claim 1 wherein the controller is coupled to the metallic contact through a first isolation circuit, and wherein the controller provides the first control signal using the first isolation circuit.

3. The high speed contact of claim 1 wherein the controller is coupled to the first power transistor through a second isolation circuit, and wherein the controller provides the second control signal using the second isolation circuit.

4. The high speed contact of claim 1 wherein the controller is coupled to the second power transistor through a third isolation circuit, and wherein the controller provides the third control signal using the third isolation circuit.

5. The high speed contact of claim 1 wherein the second power transistor further comprises a sense point for providing the sense signal.

6. The high speed contact of claim 5 wherein the high speed contact further comprises a fourth isolation circuit coupled to the sense point and the controller.

7. The high speed contact of claim 6 wherein the fourth isolation circuit comprises an amplifier coupled to the sense point and an optocoupler coupled to the amplifier and to the controller, the amplifier providing an amplified sense signal.

8. The high speed contact of claim 7 further comprising:

an oscillator coupled to the controller; and a transformer coupled to the oscillator and to the second power transistor, wherein the oscillator provides the third control signal through the transformer.

9. The high speed contact of claim 8 wherein the transformer is coupled to a power supply circuit for generating DC power.

* * * * *